United States Patent [19]

Nurk

[11] 4,047,401

[45] Sept. 13, 1977

[54] METHOD FOR FORMING A CLOSED TOE

[75] Inventor: Siegfried Nürk, Berkheim, Germany

[73] Assignee: Gottlieb Eppinger, Denkendorf, Germany

[21] Appl. No.: 559,785

[22] Filed: Mar. 19, 1975

Related U.S. Application Data

[63] Continuation of Ser. No. 340,950, March 14, 1973, abandoned.

[30] Foreign Application Priority Data

Mar. 16, 1972 Germany ..... 2212749

[51] Int. Cl.[2] ..... D04B 15/02; D04B 9/54; D04B 9/56

[52] U.S. Cl. ..... 66/187; 66/95

[58] Field of Search ..... 66/14, 26, 187, 95

[56] References Cited

U.S. PATENT DOCUMENTS

| | | | |
|---|---|---|---|
| 3,340,707 | 9/1967 | Currier | 66/26 |
| 3,626,724 | 12/1971 | Wignall et al. | 66/14 |
| 3,626,726 | 12/1971 | Findlay et al. | 66/187 X |
| 3,757,539 | 9/1973 | Millar | 66/173 |
| 3,768,277 | 10/1973 | Uhlir | 66/14 |
| 3,823,578 | 6/1974 | Voda | 66/14 |
| 3,841,113 | 10/1974 | Lucke et al. | 66/187 |

FOREIGN PATENT DOCUMENTS

| | | | |
|---|---|---|---|
| 1,185,259 | 3/1970 | United Kingdom | 66/187 |

*Primary Examiner*—Mervin Stein
*Assistant Examiner*—Andrew M. Falik

[57] ABSTRACT

A process for the manufacture of a tubular fabric such as stockings and the like having a closed toe by knitting same on a circular knitting machine having two needle beds in which two layers are formed when reaching the toe, the two layers then being twisted relative to each other through at least 180° and then joined by a connected course so that a welt is formed whereby the stocking is more comfortable.

9 Claims, 9 Drawing Figures

METHOD FOR FORMING A CLOSED TOE

Figure 1:
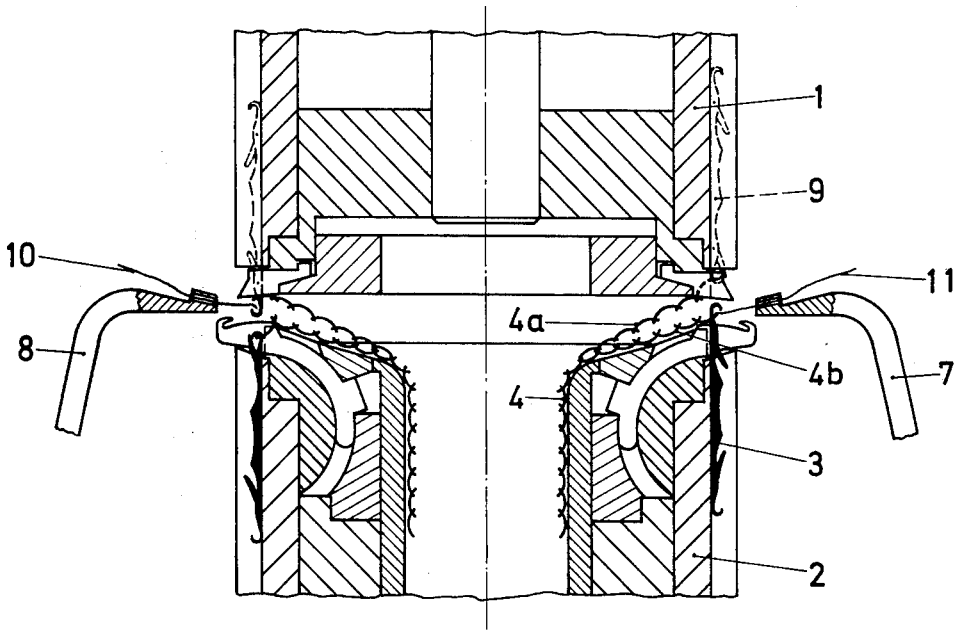

This is a continuation of application Ser. No. 340,950, filed Mar. 14, 1973, now abandoned.

In German Auslegeschrift No. 1,284,557 and Swiss Pat. No. 466,887 processes have been disclosed which, for the first time, enable the toes of tubular fabrics produced on circular knitting machines to be closed automatically without an additional sewing or looping operation. In both processes, part of the first loop course of the toe is first taken up by the hooks of a transfer device; then a stocking welt consisting of two layers is formed; then the two layers are twisted by 180° or more by rotating the transfer device relative to the needle cylinder; and, finally, the last stitch course of the toe is transferred back to the cylinder needles.

When the process of German Auslegeschrift No. 1,284,557, wherein the production of the tubular fabric is started with the toe, is applied to the manufacture of stockings or tights, then several stitch courses must be formed after the terminating stocking welt in order to prevent laddering. This has the disadvantage that the stocking becomes comparatively unelastic precisely in the area requiring high elasticity. Moreover, a pressure edge or roll is formed at the juncture of the two layers, which is troublesome in use.

In the process of Swiss Pat. No. 466,887 this roll, which is necessary for the prevention of ladders, is not formed at the upper end of the stocking, but at the start of the toe. However, the roll is troublesome also in this case, because it exerts a disagreeable pressure either in the area of the sole during walking or, if tight shoes are worn, in the area of the front of the foot.

Another process for the automatic closure of the toe is known from German Offenlegungsschrift No. 1,801,571. In this process, the starting course of the toe is again partly transferred to the hooks of a transfer device and then a steadily increasing pocket is formed by continuing to work in the normal way as in the production of stocking welts. However, this pocket is not twisted in itself, but is drawn together at its deepest point from outside with the aid of a lacing thread and closed in this way, whereupon the stitches held by the hooks are transferred back to the cylinder needles. Apart from the disadvantage that additional appliances are required for introducing the lacing thread, the formation of a troublesome roll cannot be obviated in this process either, if the toe of the stocking welt is to be secured against ladders by several roving courses.

Finally, the process known from German Offenlegungsschrift No. 1,801,571 can also be carried out on double-cylinder machines (see German Offenlegungsschrift No. 1,931,970), if some of the knitting needles are transferred to the upper needle cylinder in order to be used for securing part of the starting course of the stocking welt. It is true that the disadvantages mentioned above cannot be obviated by this process, but it has the advantage of being suitable for the production of men's socks and the like.

The object of the present invention is to provide a process and a circular knitting machine for the manufacture of tubular fabrics with a closed toe, which enables the aforesaid rolls to be shifted to those areas of the tubular fabric where they are not troublesome in use.

Starting from a process carried out on circular knitting machines for the production of closed toes of tubular fabrics, wherein the latter are provided after completion with a stocking welt, the two layers of which are twisted relative to each other by at least about 180°, the invention is characterised in that a circular knitting machine with two needle beds is used and that, for the simultaneous production of the two layers, part of the stitches are formed from the start of the toe in one needle bed and part of the stitches are formed in the other needle bed by knitting at each knitting point alternately only in one or only in the other needle bed; that the two needle beds are subsequently rotated relative to each other; and that then the two layers are joined together by working at least at one knitting point with all needles which have participated in the previous knitting process.

The invention offers the advantage that the connecting course of the two layers is situated in the immediate vicinity of the toe. For this reason, any ladder-proofing device which follows the connecting course cannot form a troublesome roll, even if comparatively strong yarns are used, as in the production of men's socks and the like. Another essential advantage consists in that only a few stitch courses are necessary for ladder-proofing because, in contrast to tubular goods manufactured according to known processes, these tubular fabrics are not stretched in use and hence their durability is improved.

In a preferred development of the invention the toe is formed from yarns of different thickness and/or different properties. It has proved especially advantageous first to form the inner and outer layers throughout from the same yarn as the remaining stocking and then to produce the last knit course of the toe from a weaker yarn. In this case, the twist of the two layers is completely transferred after completion of the tubular fabric to the area consisting of the weaker yarn, whereas the stitch wales of the other parts of the two layers are almost parallel to each other.

The process according to the invention is suitable for double-cylinder machines wherein, for example, one half of the needles is guided in the upper needle cylinder and the other half of the needles is guided in the lower needle cylinder, and it can also be used in circular border knitting machines which are provided with a transfer device for transferring selected stitches from the cylinder needles to the dial needles, and vice versa.

Consequently, the invention is further characterised by a double-cylinder circular knitting machine comprising between the two needle cylinders a coupling which enables the two needle cylinders to be rotated relative to each other, as well as by a circular border knitting machine comprising between the needle cylinder and the dial a coupling enabling the needle cylinder to be rotated relative to the dial.

Starting from a tubular fabric with a closed toe consisting of a stocking welt with two layers which are twisted relative to each other by at least 180°, the invention is finally characterised in that the juncture between the two layers which is provided with a ladder-proofing device is arranged in the immediate vicinity of the toe.

Figure 2:
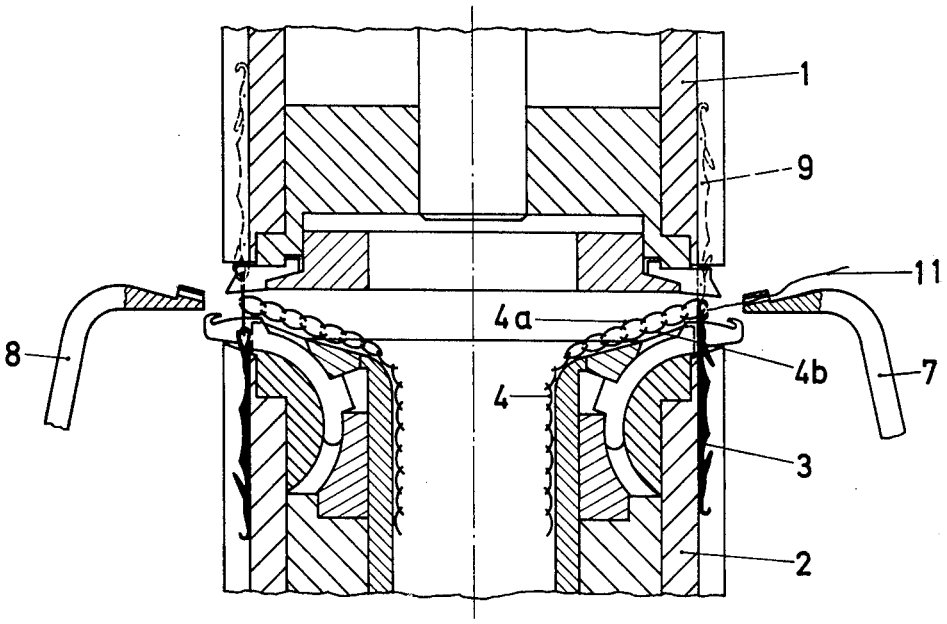
Figure 3:
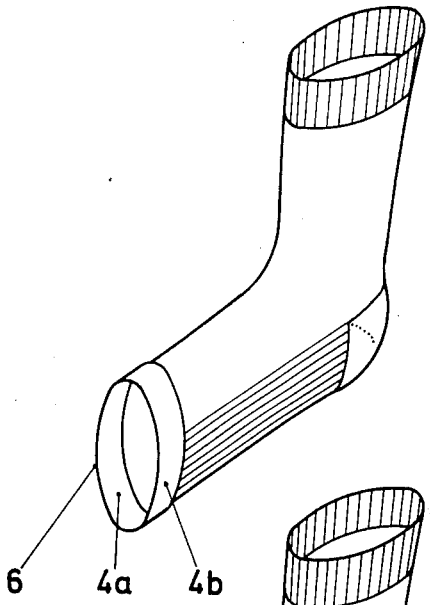
Figure 4:
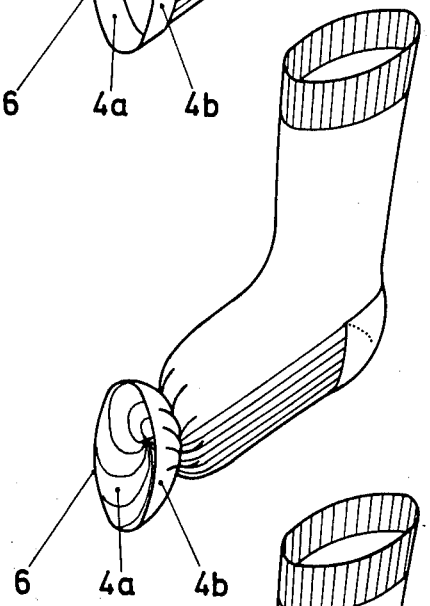
Figure 5:
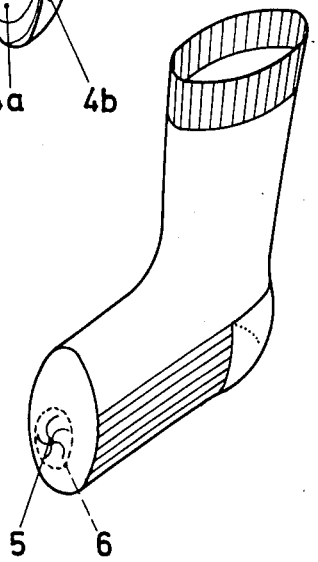

An embodiment of the invention will now be described by way of example with reference to the accompanying drawings, wherein:

FIG. 1 is a vertical part-section of the two needle cylinders of a double-cylinder circular knitting machine and illustrates a certain stage of the knitting process, FIG. 2 shows the section of FIG. 1 at another stage of the knitting process, FIGS. 3 to 5 show stockings produced on the double-cylinder circular knitting machine, the toes being shown in different versions.

FIGS. 6 to 9 diagramatically illustrate the formation of the closed toe portion in a double bed knitting machine.

In the production of stockings 4, the knitting process is started in the usual way with the upper edge and knitting is carried out in known manner as far as the start of the toe. At the moment in time when the manufacture of the toe of the stocking is to start, some of the needles, preferably every other needle, are transferred to the upper needle cylinder, as seen in FIG. 1.

At the same moment in time the needle cams (not shown) are so adjusted that at each knitting point stitches are formed only in the upper needle cylinder 1 or only in the lower needle cylinder 2. Consequently, in a double-system circular knitting machine, for example, only plain stitches are formed in the first knitting system by the first, third, fifth, etc. needles 3, whilst only reverse stitches are formed in the second knitting system by the second, fourth, sixth, etc. needles 9 (see FIG. 1). This results in a double-layer fabric represented in the sectional view of FIG. 3 by the two layers 4*a*, 4*b*. When a piece of fabric approximately corresponding to the size of the toe of a stocking is completed, the needles 3 and 9 in the two needle cylinders 1 and 2 are guided into the non-knitting track. Subsequently, the needle cylinders 1 and 2 are rotated relative to each other by a certain angle, preferably amounting to somewhat more than 180°. In this way, mainly the inner layer 4*a* is twisted, whereas the stitch wales of the other layer 4*b* are only slightly twisted.

All needles 3 and 9 are then returned to the knitting track as seen in FIG. 2. When the process is continued, however, stitches are formed in one or in both knitting systems with all needles 3 and 9 simultaneously, so that the two layers 4*a*, 4*b* are joined together at least in one stitch course, some additional courses 6 being subsequently formed.

For the connecting course and the subsequent roving courses which after completion of the stocking 4 form the centre 5 (FIG. 5) of the closed toe, a thin yarn is preferably used, in order to prevent an unattractive accumulation of material to be formed by the twist.

The roving courses 6 following after the connecting course are terminating courses which are ladder-proofed in known manner and are preferably knitted with a ladder-proof pattern.

When the needles 3 and 9 have thrown off the finished stocking, the latter is conveyed by an air stream into a collecting tray (not shown). In this state, however, the ejected stocking (FIG. 4) has not yet its normal appearance. The normal form is given to the stocking by pressing the toe out by hand or by pulling the stocking over a shape whereby it is brought into the final form indicated in FIG. 5.

The stocking 4 shown in FIG. 3 differs from the stockings illustrated in FIGS. 4 and 5 in that the two layers 4*a*, 4*b* are untwisted prior to the closing of the toe by means of the stitch courses 6. It can be seen from this illustration that the untwisted toe has the appearance of a conventional stocking welt.

The invention has been described above in relation to a double-cylinder circular knitting machine with two knitting feeds where, during the production of the two layers 4*a*, 4*b*, threads 11 and 10 respectively, were fed by means of thread guides 7 and 8 in one knitting feed (FIG. 1, right-hand side) only to the needles 3 in the lower needle cylinder and in the other knitting feed (FIG. 1, left-hand side) only to the needles 9 in the upper needle cylinder 1.

Figure 9:
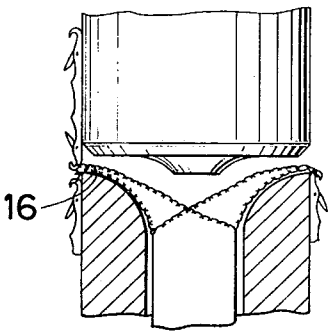
Figure 8:
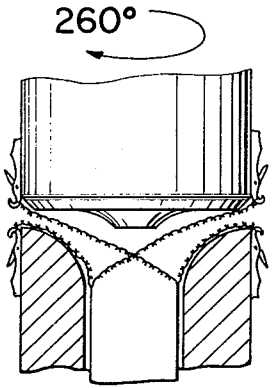
Figure 7:
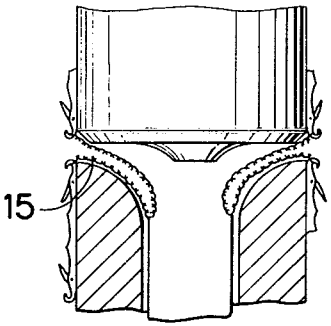
Figure 6:
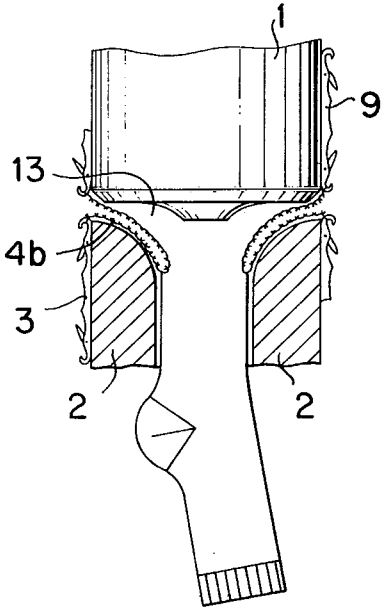

The formation of the closed toe portion 13 joining the main portion 14 is sketched in FIGS. 6 to 9. After the stitches of the last course of the main portion 13 are partly distributed on the needles 3 of lower needle cylinder 2, and the remaining part on the needles 9 of the upper cylinder 1, knitting is continued on one knitting system each so that the layers 4*a* and 4*b* are formed (FIG. 6). The last courses of layer 4*a* and 4*b* are knitted with a thin thread which is indicated by the reference number 15 (FIG. 7). After this the two layers 4*a* and 4*b* are twisted relative to each other by 260° (FIG. 8) whereafter the stitches of the last course formed in the upper cylinder 1 are transferred to needles of the lower cylinder 2. Then with the needles of lower cylinder 2 a connection line is formed followed by some antiraveling courses which is indicated by the reference number 16 (FIG. 9).

However, the invention is not limited to the embodiment described above. For example, it is not necessary for every other needle to operate in the upper needle cylinder, since the two layers 4*a*, 4*b* can be produced with different numbers of needles. Furthermore, the pattern chosen before or after the production of the two layers 4*a*, 4*b* is of no importance. It is possible, for example, to produce a smooth material or a rib material before the start of the toe, because in order to produce the toe it is only necessary to distribute the needles in a certain way between the two needle cylinders. In a similar way it is possible to return all needles to the lower needle cylinder in order to produce the connecting course of the two layers and the subsequent roving courses.

It is further possible to obtain ladder-proofing in a different way, for example by melting the roving courses 6 together by means of glowing wires or the like.

Finally, the invention is not limited to double-cylinder circular knitting machines; it can be applied in a suitable way to circular border knitting machines. If, however, knitting is carried out only on the cylinder needles before starting the toe, a transfer device is required in order to transfer part of the stitches hanging on the cylinder needles to the corresponding dial needles.

Devices for rotating two needle beds relative to each other, such as are used for twisting the two layers 4*a*, 4*b*, are known from German Offenlegungsschrift No. 1,284,557 and Swiss Pat. No. 466,887. Admittedly, the devices there described are only known in combination with a dial carrying the transfer plates, but they can be used without modification for dials with dial needles or for the second needle cylinder of a double-cylinder circular knitting machine.

Finally, the invention is also not limited to circular knitting machines with a certain number of knitting feeds. The only requirement for carrying out the process of the invention is a circular knitting machine with two needle beds and two knitting points, one being suitable for producing the layer 4*a* and the other for producing the layer 4*b*. Consequently, circular border machines such as are described in U.K. Pat. No. 1,236,256 can also be used for the purposes of the invention.

The particular advantage of the process of the invention consists in that the roving courses 6 which are provided with the ladder-proofing are tightened in the finished stocking to a comparatively small diameter and are moreover arranged at the extreme end of the toe so that they are not troublesome in use or subjected to excessive tensile stress.

The process of the invention can be applied in the same way to the production of stockings of all kinds or of tights with a stocking welt.

The tubular goods described above may be produced on a circular knitting machine comprising a rotatable needle cylinder, a rotatable dial and a coupling between a driving system for the cylinder and the dial. Circular knitting machines of this type are known from U.S. Pat. No. 3,340,707, the only difference between the known machine and a machine for producing the tubular goods of this invention being the fact that knitting needles are mounted on the dial instead of transfer jacks. The two layers 4*a*, 4*b* may be knitted in the same way as in disclosed in the British Pat. No. 1,236,256. In this case it is not necessary to transfer the loops from the dial needles to the cylinder needles after relative rotation of the dial and the cylinder, because subsequent to this rotation the two layers may be connected by simultaneously forming loops on the dial needles and the cylinder needles in two systems being exactly opposite to each other. In case of producing tubular goods of this invention on a double cylinder knitting machine the same coupling as described in U.S. Pat. No. 3,340,707 may be used for producing relative motion of the two cylinders. A machine of this type is disclosed in German Offenlegungsschrift No. 2,227,015 published on Dec. 28, 1972, which corresponds with U.S. Pat. No. 3,823,578 to Voda dated July 16, 1974.

What I claim is:

1. A process for the production of a closed toe on a circular knitting machine having two needle beds, each needle bed having at least one knitting system, comprising the steps of knitting a main fabric body portion by forming loops on needles of at least one of said beds; then knitting a closed toe portion by producing two layers of tubular fabric, one within the other, by knitting only with selected needles of said one needle bed at one of the knitting systems and only with selected needles of the other needle bed, when in a predetermined manner part of the loops of the last knitting course of the main portion are distributed to said selected needles of said one needle bed and the remaining loops of said last knitted course to said selected needles of the other needle bed; subsequently rotating the two needle beds relative to each other so that the two layers of the tubular fabric are twisted relative to each other through at least 180° whereas the stitches comprising the last course of said body portion are not held by any needle during this twisting; knitting at least one connecting course using all loops of the last courses of said two layers, and finally joining said two layers together in a ladder-proof manner.

2. A process according to claim 1 and further comprising knitting at least one ladder-proofing course following the formation of the connecting course for joining said two layers.

3. A process according to claim 2 wherein a plurality of ladder-proofing courses are knitted for ladder-proofing.

4. A process according to claim 1, wherein the two layers of tubular fabric are twisted relative to each other between 180° and 360°.

5. A process according to claim 1 in which the toe is formed from yarns of different properties.

6. A process according to claim 1 in which the two layers are formed from yarns of different strength.

7. A process according to claim 6 in which the inner layer is formed from the same yarn as used in making the tubular fabric and the outer layer is formed from a yarn of different strength.

8. A process according to claim 1, in which the circular knitting machine is a double cylinder machine, substantially one half the needles being guided in the upper needle cylinder and the remainder of the needles being guided in the lower needle cylinder.

9. A tubular fabric having a main body portion and a closed toe portion and being knitted with said main portion first and said toe portion last on a circular knitting machine having two needle beds, said toe portion being an integral extension of said main portion at one end thereof; wherein said toe portion consists of a stocking welt beginning at the end of said main portion and having two layers of fabric which are twisted relative to each other through at least 180° and which are joined at their ends in close proximity to the twisted portion and remote from the main body portion with said joining effected by at least one connecting course and a small number of additional courses in a ladder-proof manner.

* * * * *